United States Patent [19]

Sugama et al.

[11] Patent Number: 4,659,395

[45] Date of Patent: Apr. 21, 1987

[54] DUCTILE POLYELECTROLYTE MACROMOLECULE-COMPLEXED ZINC PHOSPHATE CONVERSION CRYSTAL PRE-COATINGS AND TOPCOATINGS EMBODYING A LAMINATE

[75] Inventors: Toshifumi Sugama, Mastic Beach; Lawrence E. Kukacka, Port Jefferson; Neal R. Carciello, Bellport, all of N.Y.

[73] Assignee: The United States of America as represented by the United States Department of Energy, Washington, D.C.

[21] Appl. No.: 795,141

[22] Filed: Nov. 5, 1985

[51] Int. Cl.[4] ..... C23C 22/17

[52] U.S. Cl. ..... 148/6.15 Z; 148/400

[58] Field of Search ..... 148/6.15 Z, 31.5

[56] References Cited

U.S. PATENT DOCUMENTS

| | | | |
|---|---|---|---|
| 3,169,039 | 7/1965 | Herbst | 427/409 |
| 3,941,562 | 3/1976 | Hollingshad | 252/389 A |
| 4,052,232 | 10/1976 | Brock et al. | 148/6.15 Z |
| 4,163,702 | 8/1979 | Richert | 204/181 T |
| 4,215,035 | 7/1980 | Memering | 260/45.75 |
| 4,368,139 | 1/1983 | Pollock | 252/384 |
| 4,427,459 | 1/1984 | Goltz | 148/6.15 R |

*Primary Examiner*—Sam Silverberg

*Attorney, Agent, or Firm*—Margaret C. Bogosian; James W. Weinberger; Judson R. Hightower

[57] ABSTRACT

This invention relates to a precoat, laminate, and method for ductile coatings on steel and non-ferrous metals which comprises applying a zinc phosphating coating solution modified by a solid polyelectrolyte selected from polyacrylic acid (PAA), polymethacrylic acid (PMA), polyitaconic acid (PIA), and poly-L-glutamic acid. The contacting of the resin with the phosphating solution is made for a period of up to 20 hours at about 80° C. The polyelectrolyte or the precoat is present in about 0.5–5.0% by weight of the total precoat composition and after application, the precoat base is dried for up to 5 hours at about 150° C. to desiccate. Also, a laminate may be formed where polyurethane (PU) is applied as an elastomeric topcoating or polyfuran resin is applied as a glassy topcoating. It has been found that the use of PAA at a molecular weight of about $2\times10^5$ gave improved ductility modulus effect.

17 Claims, 5 Drawing Figures

DUCTILE POLYELECTROLYTE MACROMOLECULE-COMPLEXED ZINC PHOSPHATE CONVERSION CRYSTAL PRE-COATINGS AND TOPCOATINGS EMBODYING A LAMINATE

The U.S. Government has rights in this invention pursuant to Contract Number DE-AC02-76CH00016, between the U.S. Department of Energy and Associated Universities Inc.

BACKGROUND OF THE INVENTION

The present invention relates to a preparation, process, and material system for forming organic polyelectrolyte macromolecule-complexed zinc phosphate conversion crystal coatings, which can be deposited chemically on cold-rolled carbon steel (carbon concentration may be in the approximate range of 0.02 to 0.5%) or on non-ferrous metal surfaces such as zinc and aluminum.

SUMMARY OF THE INVENTION

This invention relates to a precoat, laminate, and method for ductile coatings on steel and non-ferrous metals which comprises applying a zinc phosphating coating solution modified by a polyelectrolyte selected from polyacrylic acid (PAA), polymethacrylic acid (PMA), polyitaconic acid (PIA), and poly-L-glutamic acid. The contacting of the resin with the phosphating solution is made for a period of up to 20 hours at about 60°-80° C. The polyelectrolyte or the precoat is present in about 0.5-5.0% by weight of the total precoat composition and after application, the precoat base is dried for at least 15 minutes and up to 5 hours at about 150° C. to desiccate. Also, a laminate may be formed where polyurethane (PU) is applied as an elastomeric topcoating or polyfuran resin is applied as a glassy topcoating. It has been found that the use of PAA at an optimum molecular weight of $2\times10^5$ gave improved ductility modulus effect.

DETAILED DESCRIPTION OF THE INVENTION

The present invention relates to a preparation, process, and material system for forming organic polyelectrolytes macromolecule-complexed zinc phosphate conversion crystal coatings, which can be deposited chemically on cold-rolled carbon steel or on non-ferrous metal surfaces such as zinc and aluminum.

The assembled complex coating is characterized primarily by its ductile nature resulting from the formation of a uniform array of plasticized fine, dense crystals and a primer action which results in the formation of strong adhesive forces at the complex coating/protective polymer topcoat interface. These flexible crystalline coatings can be produced according to the following deposition procedures: the steels or non-ferrous metals, treated by rinsing with washing reagents as a first surface modification stage, are immersed for up to 20 hours at 80° C. in a zinc phosphating liquid which is modified by the incorporation of polyelectrolyte macromolecules, such as polyacrylic acid (PAA), polymethacrylic acid (PMA), polyitaconic acid (PIA), and poly-L-glutamic acid. The basic zinc phosphating liquid consists preferably of a solution of 4 to 9 parts zinc orthophosphate dihydrate and 96 to 91 parts 15% $H_3PO_4$. The employed polyelectrolyte macromolecules have an average molecular weight ranging from between 10,000 to 300,000 and are used in the form of an aqueous solution containing 20 to 50% solid polymer. Thus, although the polymer in water has a high molecular weight, it is readily soluble in the phosphating liquid. The concentration of solid polyelectrolyte macromolecules in the phosphating liquid ranges from 0.5 to 5% by weight of total mass of the zinc phosphate solution. After deposition of the complex film, the substrates are dried in an air oven at 150° C. for up to 5 hours to remove any moisture from the film surface and to solidify the water soluble polymers.

Figure 1:
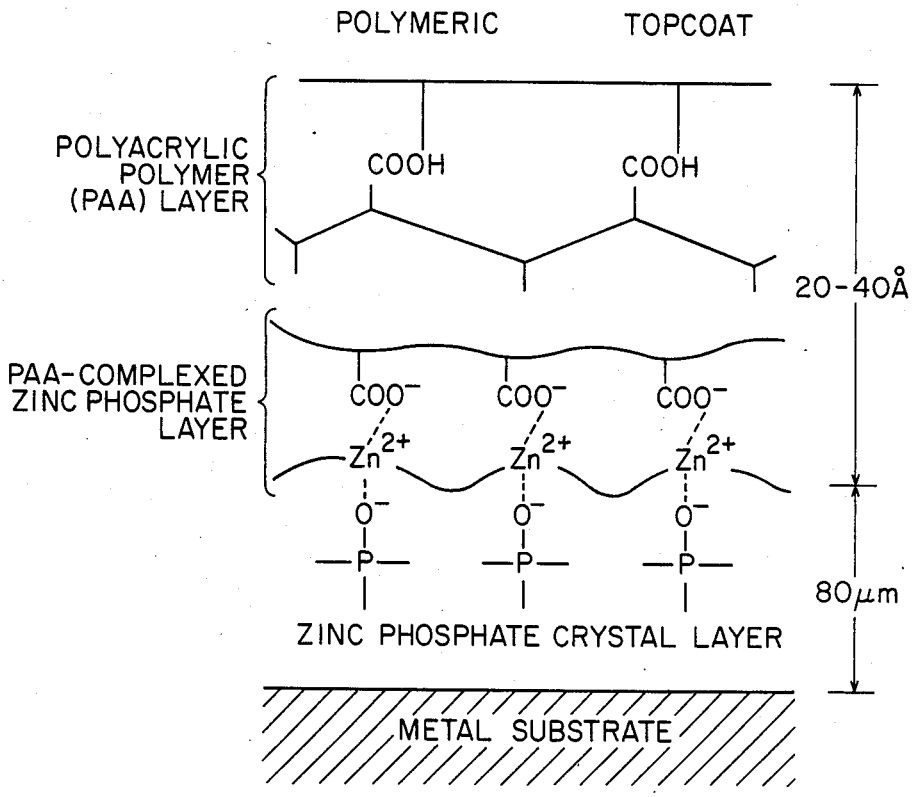
FIG. 1 is a microstructure profile of the PAA macromolecule-zinc phosphate crystal composite coatings.

The microstructure profile of the PAA macromolecule-zinc phosphate crystal composite coatings formed by the treatment described above is given in FIG. 1. As seen in FIG. 1, the conversion layer formed is composed of a bulk PAA polymer, PAA-complexed zinc phosphate, and crystalline zinc phosphate hydrate layers. The complexed PAA which is strongly chemisorbed by Zn atoms at the outermost surface sites of the crystal layers is mechanically and thermally irreversible. In this complex mechanism, the most important factor contributing to the improvement in ductility and adherent forces of the conversion film is the total thickness of the bulk PAA and PAA-complex layers. The appropriate thickness is in the range of 20 to 40 Å. The degree of increase in the interfacial chemical bonding between the polyelectrolyte macromolecule and the polymeric topcoat is related directly to the number of functional carboxylic acid (COOH) groups at the outermost surface sites of the macromolecules and the degree of surface roughness of the overlaying macromolecules. When the thickness of the precoat overlayer is >20 Å and <40 Å, the ductility of the normally brittle conventional crystal films is increased and significant improvement in adhesion is obtained.

The flexural modulus of the complexed conversion films, the adhesive strength at furan topcoat/complex film joints, and the thickness of the macromolecules are given in Table 1 as a function of the average molecular weight of the PAA polyelectrolyte macromolecules. As is evident from the table, it appears that the average molecular weight and the overlay thickness of polyelectrolyte macromolecules used in this invention act significantly to increase the flexural modulus of the crystalline conversion films and the bonding force at the macromolecule-topcoating interfaces. Table 2 shows the shear bond strength developed at the interface between the furan topcoat and complex layer modified with various polyelectrolyte macromolecules. As seen in the table, the bond strength of organic polymer-modified zinc phosphate films is approximately two times higher than that of the control specimens in the absence of the polyelectrolyte macromolecules.

TABLE 1

Properties of Complex Conversion Films Derived from Zinc Phosphating Solutions Containing 2% PAA, as a Function of M.W.

| M.W. | Thickness of overlaying macromolecules, Å | Flexural modulus, $10^6$ psi | Adhesive strength, psi |
|---|---|---|---|
| Monomer (72) | <10 | 4.50 | 650 |
| 2,000 | <10 | 6.50 | 650 |
| 5,000 | <10 | 8.50 | 800 |
| 10,000 | ≈20 | 10.20 | 1050 |
| 50,000 | ≈30 | 10.80 | 1100 |
| 90,000 | ≈30 | 11.10 | 1150 |
| 150,000 | ≈40 | 12.00 | 1200 |
| 300,000 | ≈40 | 12.45 | 1300 |
| 750,000 | <50 | 11.50 | 1050 |

TABLE 2

Effect of Various Polyelectrolyte Macromolecules Having M.W. ≈100,000 on the Improvement of Bond Strength at Furan Topcoat/Complex Layer Joints

| Macromolecules | Lap Shear Bond Strength, psi |
|---|---|
| Control* | 550 |
| Polyacrylic Acid | 1200 |
| Polymethacrylic acid | 950 |
| Polyitaconic acid | 900 |
| Poly-L-glutamic acid | 850 |

*Unmodified single zinc phosphate crystal coatings

Effects on Ductility

Figure 2:
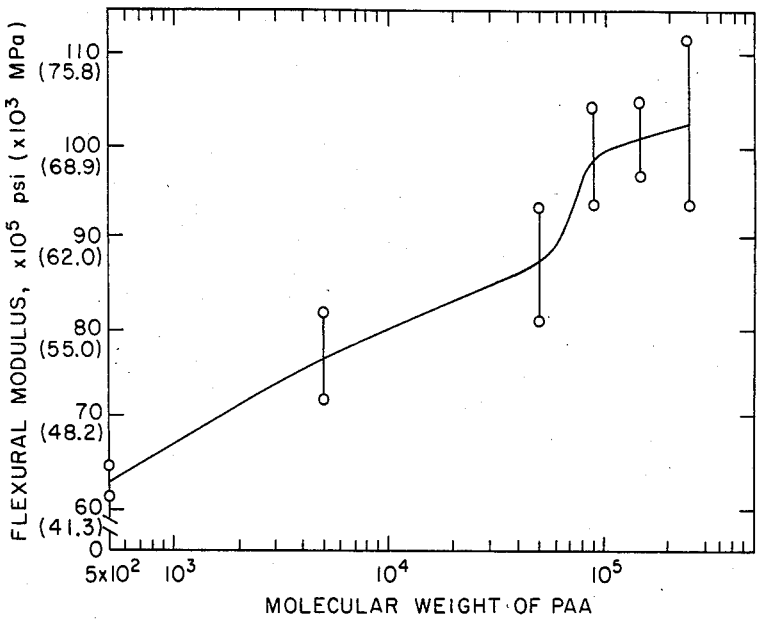
FIG. 2 shows the correlation between the flexural modulus and the molecular weight of the PAA.

The increase in the stiffness of the layers is not only due to the thickness, fineness, and density of the plasticized conversion formations but also is associated with the average molecular weight of the PAA. The effect of the PAA molecular weight (M.W.) on the flexural modulus of the precoat layers was investigated over a M.W. range of $5\times10^2$ to $2.5\times10^5$. In these studies, the complex precoats were derived from a mix solution prepared by incorporating a 3% concentration of the various PAA polymers into the conventional zinc phosphating solution. FIG. 2 shows the correlation between the flexural modulus and the molecular weight of the PAA. The curve indicates that the modulus related directly to the molecular weight. The use of PAA with a molecular weight of $2.4\times10^5$ resulted in the formation of crystal layers having a modulus 1.6 times greater than that of the layers produced with PAA of M.W. $5\times10^2$. The layers derived from acrylic acid monomer exhibited a modulus of $58.3\times10^5$ psi ($40.2\times10^3$ MPa), about 7% lower than that from M.W. $5\times10^2$. Thus, the results suggest that the M.W. of the PAA polymer plays an important role in increasing the stiffness of the complex conversion layers. This increase in stiffness also increases the ductility.

In a study conducted to understand the interplay between the topcoat and precoat in improving the stiffness and ductility of the crystal conversion layers, the two different topcoating systems described in Example 1 which follows, polyurethane (PU) classified as an elastomeric polymer and furan (FR), a glassy polymer, were used. Some mechanical properties of these polymers are given in Table 3. As is indicated in the table, the modulus of elasticity for the FR polymer was $2.28\times10^5$ psi ($1.57\times10^3$ MPa), greater by an order of magnitude than that of the PU polymer. The tensile strength and elongation values for the elastomeric PU are considerably higher than those of the glassy FR polymer. The extremely high elongation of 1040% for the PU is three orders of magnitude greater than that for the FR polymer (1%).

The adhesive characteristics for the elastomeric PU topcoat to the precoat surfaces were evaluated on the basis of 180°-peel strength tests. The test specimens used to determine the bonding force at the PU-precoat interface were prepared by overlaying an initiated PU polymer onto the metal substrate surfaces that had been modified with the zinc phosphating solutions containing up to 4% PAA polymer (M.W. 104,000). Overlaid specimens were then left in a vacuum oven at 80° C. for about 10 hours to cure the PU polymer. The 180°-peel strength tests were performed at room temperature and the results presented in Table 4 indicate that over the PAA concentration range of 0 to 3%, the peel strength increases progressively with increasing PAA content. In the absence of PAA, the bond strength was 3.88 lb/in. (0.70 kg/cm). The addition of 3% PAA increased the value by a factor of 2.6. Further increases in concentration up to 4.0% resulted in a strength reduction.

TABLE 3

Mechanical Properties of Glassy Furan and Elastomeric Polyurethane Polymers Used as Topcoating Systems

| Topcoating | Modulus of Elasticity, psi (MPa) | Tensile Strength, psi (MPa) | Elongation, % |
|---|---|---|---|
| Furan | $2.28\times10^5$ ($1.57\times10^3$) | 1820 (12.5) | 1 |
| Polyurethane | $1.47\times10^4$ ($1.01\times10^2$) | 3390 (23.4) | 1040 |

TABLE 4

180°-Peel Strength of Polyurethane Complex Crystal Coating Interface and Lap Shear Bond Strength of Complex Substrate-to-Complex Substrate Furan Adhesives

| PAA, % | Peel Strength, lb/in. (kg/cm) | Lap-Shear Bond Strength, psi (MPa) |
|---|---|---|
| 0 | 3.88 (0.70) | 640 (4.41) |
| 1.0 | 5.63 (1.01) | 920 (6.34) |
| 2.0 | 9.41 (1.68) | 1160 (7.99) |
| 3.0 | 10.25 (1.84) | 1130 (7.79) |
| 4.0 | 8.41 (1.51) | 950 (6.55) |

Elastic Behavior of Polymer-Overlayed Precoat Layer with Topcoating

Figure 3:
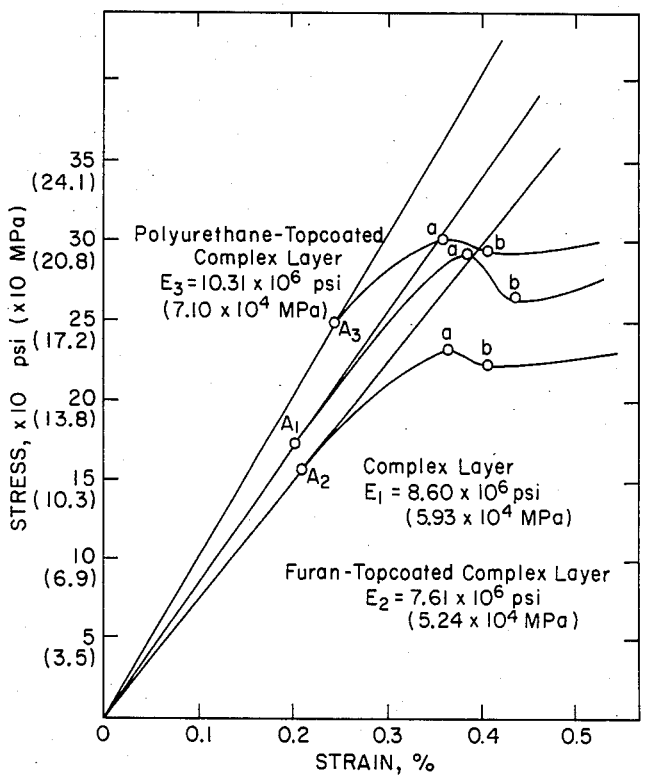
FIG. 3 is a stress-strain diagram for uncoated and PU- and FR-topcoated complex layers.

Tests were performed to obtain stress-strain diagrams for the topcoat-precoat composite layers. In this work, about 1.5 mm-thick PU and FR polymer topcoat systems were placed on complex precoat surfaces which were modified with 3% PAA having a M.W. of $1\times10^6$. Differences between the flexural modulus computed from the stress-strain relation were then used in an attempt to relate the stiffness of the precoat layer with the mechanical behavior of the topcoats. Typical stress-strain diagrams and the computer flexural modulus for these specimens are shown in FIG. 3.

These results indicated that the flexural modulus of the PU-topcoated composite layer specimens is $10.31\times10^6$ psi ($7.10\times10^4$ MPa), corresponding to an improvement of about 20% over that of the specimens without the topcoating. In contrast, the modulus for FR-coated composite specimens was about 12% less than that of the control. Further, the yield stress of the precoat specimens was improved about 10% by overlaying with PU polymer, whereas a stress reduction of about 16% was noted for FR-overlapped layers.

The features and mode of the fracture-initiating cracks at the yield stress for the untopcoated and FR- and PU-topcoated composite surfaces were investigated using scanning electron microscopy. For the untopcoated precoat surfaces, it was confirmed from the diverging crack pattern that the microcrack propagation is diverted around a bulky coarse crystal rather than passing through it. The width of the microcrack, which is very difficult to identify, was about 4 m. The small size of the flaw produced at the yield stress suggests that the complex precoat layers possess a high degree of flexibility and stiffness.

When compared to the untopcoated specimens, the fracture origin under tension of the FR-topcoated specimens was completely different. A linear cracking pattern, resulting in failure of the glassy FR polymer is apparent in the topcoated specimen, which exhibits a relatively smooth face. Thus, the fracture of the brittle FR topcoat was probably due to poor plastic deformation in connection with a rapid progression of crack growth. The size of the flaw was determined from the SEM fracture micrographs to be about 30 $\mu$m, more than seven times larger than that in the failed precoat layer without the topcoat system.

In contrast, no signs of cracking were detected for the composite layer surface containing the elastomeric PU topcoat. These results apparently verify that the FR glass topcoat, characterized by its high elastic modulus, extremely low elongation, and good bond strength, acts to promote crack propagation at the interfacial regions. Although some nonlinear stress distribution is observed prior to the deformation failure, the fracture of FR-precoat composition systems occurs almost immediately following the formation of a visible tensile crack. The initial cracking of this composite occurs through the FR polymer-precoat stress, whereby load is transferred from the brittle FR to the ductile crystal layers. For the PU superposition, it was microscopically observed that growth of the interfacially generated initial crack is more likely to be associated with the crystalline precoat sites than with the PU polymer sites. The most significant effect of the use of the high tensile and elongation and low modulus PU topcoat is, therefore, to delay and control the onset of tensile cracking of the precoat layers. The interfacial bond failure occurs after the precoat layer reaches its yield point. Thus, the crack-arresting properties of elastomeric topcoats are found to play the major role in improving the mechanical behavior of the precoat layer during interfacial failure processes.

On the other hand, the effect of the adhesive bonds at the topcoat/precoat interfaces on the elastic behavior of the composite layers cannot be fully ascertained from the experimental data. To gain additional information, precoat surfaces were exposed to a 100% relative humidity (R.H.) atmosphere at 24° C. for up to 10 days before application of initiated PU and FR resins. The presence of any moisture on the substrate surfaces would result in a decrease in bonding force with these adhesives. The humidity also reduced the curing rate of the polymeric topcoat in the vicinity of the wetted precoat surfaces. This reduced polymerization rate relates directly to a decrease in elastic modulus of topcoating materials.

Figure 4:
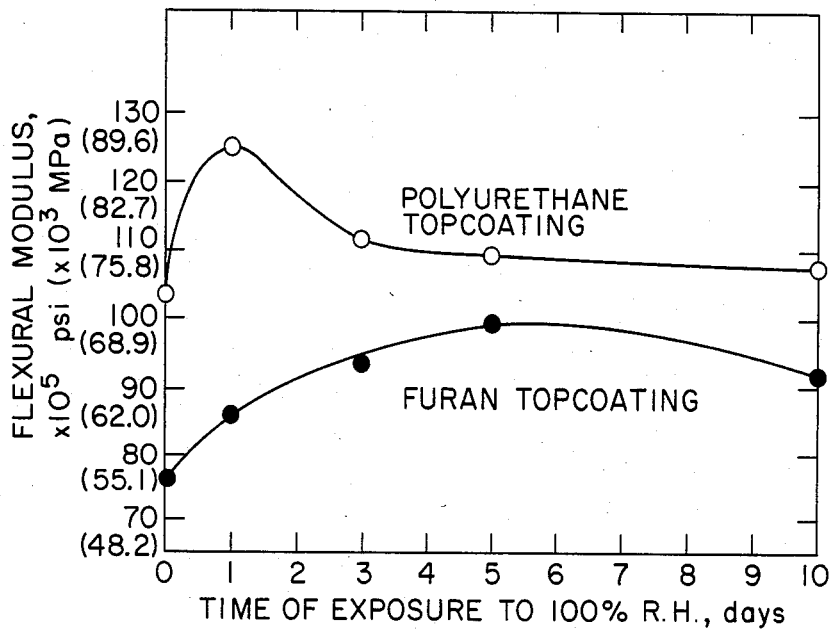
FIG. 4 shows the changes in flexural modulus of PU- and FR-topcoated complex crystal layers as a function of time of exposure to 100% relative humidity - o is with a PU-topcoating and • is with a FR topcoating.

Curves showing the flexural modulus for PU- and FR-topcoated composite layers prepared after exposure of the precoat surfaces to 100% R.H. for various periods of time are shown in FIG. 4. These data suggest that the presence of a certain amount of moisture on the precoat surfaces may increase the flexural modulus of the composite layers. Surfaces overlaid with PU after 24-hour exposure to 100% R.H. exhibited the maximum modulus of $125\times10^5$ psi ($86.13\times10^3$ MPa). This correponds to an improvement of about 20% over that of the unexposed surfaces. Extending the exposure time for up to 10 days resulted in a modulus reduction, but the value was still higher than that from the dry surface. For the FR-topcoated systems, the data indicate that the modulus increased with exposure time up to about 5 days to an ultimate modulus of about $100\times10^5$ psi ($68.90\times10^3$ MPa). Beyond that time, the modulus declined to a value of about $91\times10^5$ psi ($62.70\times10^3$ MPa) after 10 days of exposure. From the above findings, it is noted that when the resins in the curing propagations are contiguous to moisture, their polymerization rate is suppressed by the humidity existing on the substrate surfaces. This suppression of polymerization acts to produce a rubbery polymer possessing a low elastic modulus and high elongation properties. Thus, even though the interfacial bonding forces are actually reduced by the presence of surface moisture, the decreased modulus of the polymer topcoat at the interface contributes to an increase in the flexural modulus of the crystalline precoat layers. This enhances the stiffness of the composite layers. The results further suggest that the interfacial stress transfer is of major importance in the topcoat-precoat composite systems. For instance, the enhanced brittleness at the interface, when a glassy FR topcoat is used, tends to result in a more rapid decrease in the interfacial stress transfer because of an increased rate of compaction. The increased flexural modulus of the composite layers containing moisture at the interface is associated with an increase in interfacial stress transer which is due to the absorption of a certain amount of energy by the rubbery topcoat prior to the initial cracking of the precoat layers. Accordingly, the interfacial adhesive bonds were found to have a lesser effect on the crack-arresting behavior and stiffness characteristics of the composite layers.

EXAMPLE 1

The metal used in this example was nondesulfurized mild carbon steel consisting of 0.18 to 0.23% C, 0.3 to 0.6% Mn, 0.1 to 0.2% Si, and $\leqq$0.04% P. Fine crystalline polyacrylic acid (PAA) complexed zinc phosphate hydrate films were deposited onto the metal substrate surfaces. The zinc phosphating liquid consisted of 9 parts zinc orthophosphate dihydrate and 91 parts 15% $H_3PO_4$ and was modified by incorporating a PAA polymer at concentrations ranging from 0 to 4.0% by weight of the total phosphating solution. Commercial PAA, 25% solution in water, having an average molecular weight in the range of $5\times10^2$ to $5\times10^5$, was supplied by Scientific Polymer Products, Inc. The PAA-zinc phosphate composite conversion film was deposited on the metal substrates by immersing the metal for 7 hours in the modified zinc phosphating solution at 80° C. After depositing the composite conversion films, the substrates were left in a vacuum oven at 150° C. for about 5 hours to remove any moisture from the film surfaces and to solidify the PAA macromolecules.

Commercial-grade polyurethane (PU) M313 resin (the Lord Corporation) was applied as an elastomeric topcoating. The polymerization of PU was initiated by incorporating a 50% aromatic amine curing agent M201. Furan (FR) 1001 resin employed as a glassy topcoating system was supplied by the Quaker Oats Company. The condensation-type polymerization of the FR resin was initiated by the use of 4 wt % QuaCorr 2001 catalyst, which is an aromatic acid derivative. These initiated topcoatings were cured in the oven at a temperature of 80° C.

To evaluate the mechanical properties of the layers, the stress-strain relation and modulus of elasticity in flexure were determined using computerized Instron Flexure Testing Systems, operating at deflection rates of 0.5 to 0.05 mm/min. The determination of the stress-strain curve was made on the tensile zones of metal plate specimens, 6.2 cm long by 1.3 cm wide by 0.1 cm thick, subjected to three-point bending at a span of 5.0 cm.

The approximate thickness of the complexed precoat layers deposited on the metal substrate surfaces was measured by AMR 100-A scanning electron microscopy (SEM) observation of the edge view of sliced sections. SEM was also used to observe the crack-initiation and crack-arrestment regions of fractured surfaces of polymer-topcoated precoat layers.

Modulus of elasticity, tensile strength, and elongation tests for the cured topcoat polymers were performed on dumbell-like samples 7.0 cm long and 0.5 cm wide at the narrowest section. Stress-strain diagrams were obtained with a tensile tester having a crosshead speed of 0.5 mm/min. All strength values reported are for an average of three specimens.

Peel strength tests of adhesive bonds at the polyurethane topcoat-modified metal substrate interfaces were conducted at a separation angle of about 180° C. and a crosshead speed of 5 cm/min. The test specimens consisted of one piece of flexible polyurethane topcoat, 2.5 by 30.5 cm, bonded for 15.2 cm at one end to one piece of flexible or rigid substrate material, 2.5 by 20.3 cm, with the unbonded portions of each member being face to face. The thickness of the polyurethane topcoat overlayed on the complex crystal surfaces was about 0.95 mm.

The lap-shear tensile strength of metal-to-metal rigid furan adhesives was determined in accordance with the modified ASTM method D-1002. Prior to overlapping between metal strips 5.0 cm long, 1.5 cm wide, and 0.2 cm thick, the 1.0- ×1.5-cm lap area was coated with the initiated furan adhesive. The thickness of the overlapped film ranged from 1 to 3 mil. The Instron machine was operated at a crosshead speed of 0.5 mm/min. The bond strength values for the lap shear specimens are the maximum load at failure divided by the total bonding area of 1.5 $cm^2$.

EXAMPLE 2

Figure 5:
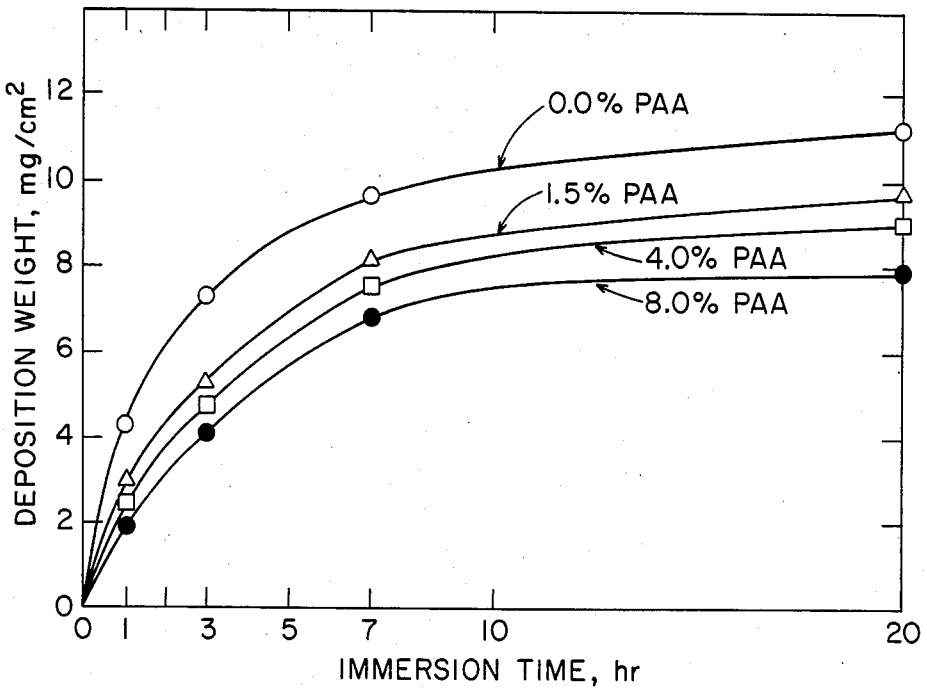
FIG. 5 shows the effect of PAA macromolecules on the coating weight of zinc phosphate deposition. o indicates 0.0% PAA solution; Δ indicates 1.5% PAA solution; □ indicates 4.0% PAA solution; and • indicates 8.0% PAA solution.

To determine the ability of PAA polyelectrolyte macromolecules to decrease the quantity of crystalline zinc phosphate conversion deposits, the following test procedures were used. The water soluble PAA solutions in amounts ranging from 0 to 8.0% by weight of total zinc phosphating liquid mass were dissolved in the phoshating solution by stirring. The rinsed metal plates were then immersed for up to 20 hours in the phosphating liquid with and without PAA at 80° C. Immediately after immersion, the plates were placed in a vacuum oven for 10 hours at 150° C. The surface of the dried plate was then washed with acetone solvent to remove the multiple-layer PAA polymer coating from the deposition films and then rinsed with water. The deposition weight, expressed as mg/$cm^2$ of treated metal surface, was consequently determined by a method in which the conversion crystal film was removed by scraping the surface of a weighed plate, and the plate was reweighed. The results from the above tests are given in FIG. 5.

We claim:

1. A metal lamina consisting of a steel and non ferrous metal base and a precoat polymer layer consisting of a zinc phosphating layer modified by a polymer coating of about 20A–40A thickness of a polyelectrolyte selected from the group consisting of polyacrylic acid, polymethacrylic acid, polyitaconic acid, and poly-L-glutamic acid, said precoat polymer layer was applied from a zinc phosphate and polyelectrolyte composition wherein the polyelectrolyte is present in about 0.5–5% by weight and has a molecular weight of about 10,000–300,000.

2. The precoat according to claim 1 wherein the precoat is formed from an aqueous solution which contains 20–50% solid polymer.

3. The precoat according to claim 1 wherein the polyelectrolyte is polyacrylic acid with a molecular weight of about $2\times10^5$.

4. The precoat according to claim 1 wherein the polyelectrolyte has an optimum value of 3% polyacrylic acid.

5. The precoat according to claim 1 wherein the polyelectrolyte is polymethacrylic acid.

6. The precoat according to claim 1 wherein the polyelectrolyte is polyitaconic acid.

7. The precoat according to claim 1 wherein the polyelectrolyte is poly-L-glutamic acid.

8. A laminate consisting of a metal base, a precoat polymer layer consisting of a zinc phosphating layer modified by a polymer coating of about 20Å–40Å thickness of a polyelectrolyte selected from the group consisting of polyacrylic acid, polymethacrylic acid, polyitaconic acid, and poly-L-glutamic acid, and a polymeric top coating, said precoat polymer layer was applied from a zinc phosphate and polyelectrolyte composition wherein the polyelectrolyte is present in about 0.5–5% by weight and has a molecular weight of about 10,000–300,000.

9. The laminate according to claim 8 wherein the top coating is selected from the group consisting of a polyurethane polymer and a furan polymer.

10. A method of coating a steel or non-ferrous base which comprises contacting said base with a precoat consisting of an aqueous treating agent of a zinc phosphate solution modified by a polyelectrolyte having a molecular weight of about 10,000–300,000 and a concentration of about 0.5–5% by weight wherein the said polyelectrolyte is selected from polyacrylic acid, polymethacrylic acid, polyitaconic acid, and poly-L-glutamic acid wherein said contacting is made up to 20 hours at a temperature of 60°–80° C. and where said precoat base is dried for at least 15 minutes at about 150° C. thereby producing a polyelectrolyte coating in a thickness of about 20Å–40Å.

11. The method according to claim 10 wherein the zinc phosphate solution is prepared from about 1–10 $Zn_3(PO_4)_2.2H_2O$ and about 99–90 parts $H_3PO_4$(15%).

12. The method according to claim 10 wherein the precoat is prepared from an aqueous solution containing 20–50% solid polymer.

13. The method according to claim 10 wherein the polyelectrolyte is polyacrylic acid.

14. The method according to claim 10 wherein the polyelectrolyte is polymethacrylic acid.

15. The method according to claim 10 wherein the polyelectrolyte is polyitaconic acid.

16. The method according to claim 10 wherein the polyelectrolyte is poly-L-glutamic acid.

17. A method according to claim 10 which comprises coating said pre coat base with a polymeric top coat.

* * * * *